US005713434A

United States Patent [19]

Sun

[11] Patent Number: 5,713,434

[45] Date of Patent: Feb. 3, 1998

[54] ELEVATOR SAFETY SYSTEM

[75] Inventor: Lu Sun, Simsbury, Conn.

[73] Assignee: Otis Elevator Company, Farmington, Conn.

[21] Appl. No.: 499,290

[22] Filed: Jul. 7, 1995

[51] Int. Cl.[6] ..... B66B 17/00

[52] U.S. Cl. ..... 187/360

[58] Field of Search ..... 187/360

[56] References Cited

U.S. PATENT DOCUMENTS 1,209,099 12/1916 Wunning ..... 187/360 X 1,581,459 4/1926 Lindquist .

5,411,117 5/1995 Häyrinen ..... 187/360

*Primary Examiner*—Boris Milef

[57] ABSTRACT

Disclosed is a system for engaging safeties on an elevator car. The system comprising a contact surface in a hoistway and a safety tripping lever pivotally mounted on an elevator car. Upon contact by the lever with the contact surface, the safeties engage, with the contact surface preventing the safeties from disengaging until the car comes to a stop. A feature of the system for engaging safeties on an elevator car is the ability of a portion of the safety tripping lever to retract away from the contact surface upon movement of the elevator car in a direction opposite of the car's braking direction, wherein the retraction of the lever facilitates the disengagement of the safeties.

2 Claims, 7 Drawing Sheets

ELEVATOR SAFETY SYSTEM

TECHNICAL FIELD

This invention relates generally to elevators, and more particularly, to a system for engaging an elevator car's safeties.

BACKGROUND OF THE INVENTION

A typical elevator system comprises a rotatably mounted drive sheave supporting a hoist rope, where one end of the hoist rope suspends an elevator car, and the other end of the hoist rope suspends a counterweight. Upon rotation of the drive sheave, the elevator car and counterweight translate vertically in opposite directions.

Passenger safety plays an important role in the design of elevator systems. Many safety systems have been designed to prevent unintended descent or ascent of an elevator car within an elevator hoistway. This unintended descent or ascent may be due to power or mechanical failure within the elevator system, and in some cases, may be due to the severing of ropes that hoist the elevator car. Unintended descent or ascent may take the form of unintended car speeds or unintended car movement; wherein unintended car movement is when the elevator car is either moving at a time when it shouldn't be, or movement beyond the car's normal limits of travel within the hoistway. It is known that without an elevator safety system, unintended descent or ascent of an elevator car may lead to passenger injuries and damage to the elevator car and hoistway.

As part of these safety systems, the elevator car itself is equipped with braking devices known as safeties. Typically, safeties use a roller, clamp, or wedge to apply frictional pressure to the guide rails on each side of the hoistway. Upon activation, the safeties bring the elevator to a quick, safe stop.

It is well known that a governor assembly may be used to assist in the activation of the elevator's safeties. A typical elevator safety system utilizing a governor assembly comprises, in part, a governor sheave rotatably mounted in the elevator hoistway adjacent to the drive sheave, and suspending a governor rope in tension with the aid of a rotatably mounted tension sheave at the bottom of the hoistway. The governor sheave itself is part of the governor assembly, which when activated, slows the rotational speed of the governor sheave, and consequently the vertical speed of the governor rope.

The ability of the governor assembly to slow the vertical speed of the governor rope is then used to activate the elevator's safeties through the connection of the elevator safeties to the governor rope through a system of lift rods, linkages, and a safety operating lever. The safety operating lever is pivotally mounted to the elevator car frame and contains a clamp that extend away from the elevator car and is clamped to the governor rope. The pivoting of the safety operating lever actuates a series of linkages, which in turn, actuates lift rods attached to the elevator's safeties. The actuation of the lift rods engages the elevator's safeties, thereby applying frictional pressure to the guide rails on each side of the hoistway.

The prior art also discloses an elevator safety system for activating the elevator car's safeties by using a lever extending away from a side of the car, wherein the lever is fastened to the car's safety linkages. A camming surface fixed at a discrete location in the hoistway is provided for tripping the lever and activating the car's safeties. The prior art teaches that the camming surface may be placed near the bottom of the hoistway to prevent the elevator car from unintended movement beyond the lowest landing of the hoistway.

The length of the camming surface in the prior art is long enough to initially trip the lever, but also short enough so that once the safeties have been activated and the elevator car comes to a stop, the lever has room to lower and disengage the safeties. If after engagement of the car's safeties the car should stop in a position where the lever is still pressing against the camming surface, there would be no way to conventionally disengage the safeties in order to raise the car. Therefore, these prior art camming surfaces are made very short in order to ensure that there is very little possibility for the car to stop in a position where the lever would still be pressed against the camming surface. Since in the prior art, the purpose of the camming surface is only to trip the lever, a short camming surface is all that is necessary for the safeties to engage.

In order not to trip the safety lever on the way up, the prior art teaches that the camming surface is provided with a pivot point that rotates clockwise so that as the lever makes contact with the camming surface on the way up, the camming surface pivots out of the way. This procedure for returning the elevator car to a position above the camming surface also necessitates that the camming surface be short enough so that after the elevator car comes to a stop and is then raised, the lever has room to lower and to pivot the camming surface while the car is being raised.

DISCLOSURE OF THE INVENTION

It is accordingly one object of the present invention to provide a system for engaging safeties on an elevator car if the car does not stop within its normal limits of travel.

Another object of the present invention is to provide a system for engaging safeties on an elevator car, wherein if the safeties have been engaged, prevents the safeties from disengaging until the car comes to a stop.

Another object of the present invention is to provide a system for engaging safeties on an elevator car that also facilitates the disengagement of the safeties.

Still another object of the present invention is to provide a system for engaging safeties on an elevator car that reduces the depth necessary for an elevator car buffer.

Yet another object of the present invention is to provide a system for engaging safeties on an elevator car that works with pre-existing assemblies on the car for activating the safeties.

These objects are achieved in the present invention, a system for engaging safeties on an elevator car. The system comprising a contact surface in a hoistway and a safety tripping lever pivotally mounted on an elevator car. Upon contact by the lever with the contact surface, the safeties engage, with the contact surface preventing the safeties from disengaging until the car comes to a stop.

A feature of the system for engaging safeties on an elevator car is the ability of a portion of the safety tripping lever to retract away from the contact surface upon movement of the elevator car in a direction opposite of the car's braking direction, wherein the retraction of the lever facilitates the disengagement of the safeties.

An advantage of the system for engaging safeties on an elevator car is the ability of the contact surface to hold the safety tripping lever in a position engaging the car's safeties until the car has come to a stop. This ability ensures that the safeties cannot disengage while they are slowing down the elevator car.

Another advantage of the system for engaging safeties on an elevator car is the ability of a portion of the safety tripping lever to retract away from the contact surface, thereby facilitating the disengagement of the safeties. This ability allows the contact surface to extend down the hoistway a length necessary to ensure that the safeties do not disengage during braking, while also allowing the lever to pivot and facilitate the disengagement of the safeties upon movement of the car in a direction opposite of the safeties' braking direction.

Still another advantage of the system for engaging safeties on an elevator car is the diminished need for the concurrent use of a long stroke elevator car buffer. In high speed elevator applications, it is desirable to reduce the depth of the pit and the stroke of the buffer necessary to slow the movement of the elevator car past the lowest landing. The combined use of the system for engaging safeties on an elevator car, with the use of a shorter stroke buffer, would result in a cost-efficient, and effective, safety system.

Still other objects and advantages of the present invention will become readily apparent to those skilled in this an from the following detailed description, wherein only the preferred embodiments of the invention are shown and described, simply by way of illustration of the best mode contemplated of carrying out the invention. As will be realized, the invention is capable of modifications in various respects, all without departing from the invention. Accordingly, the drawings and description are to be regarded as illustrative in nature, and not as restrictive.

BEST MODE FOR CARRYING OUT THE INVENTION

Figure 1:
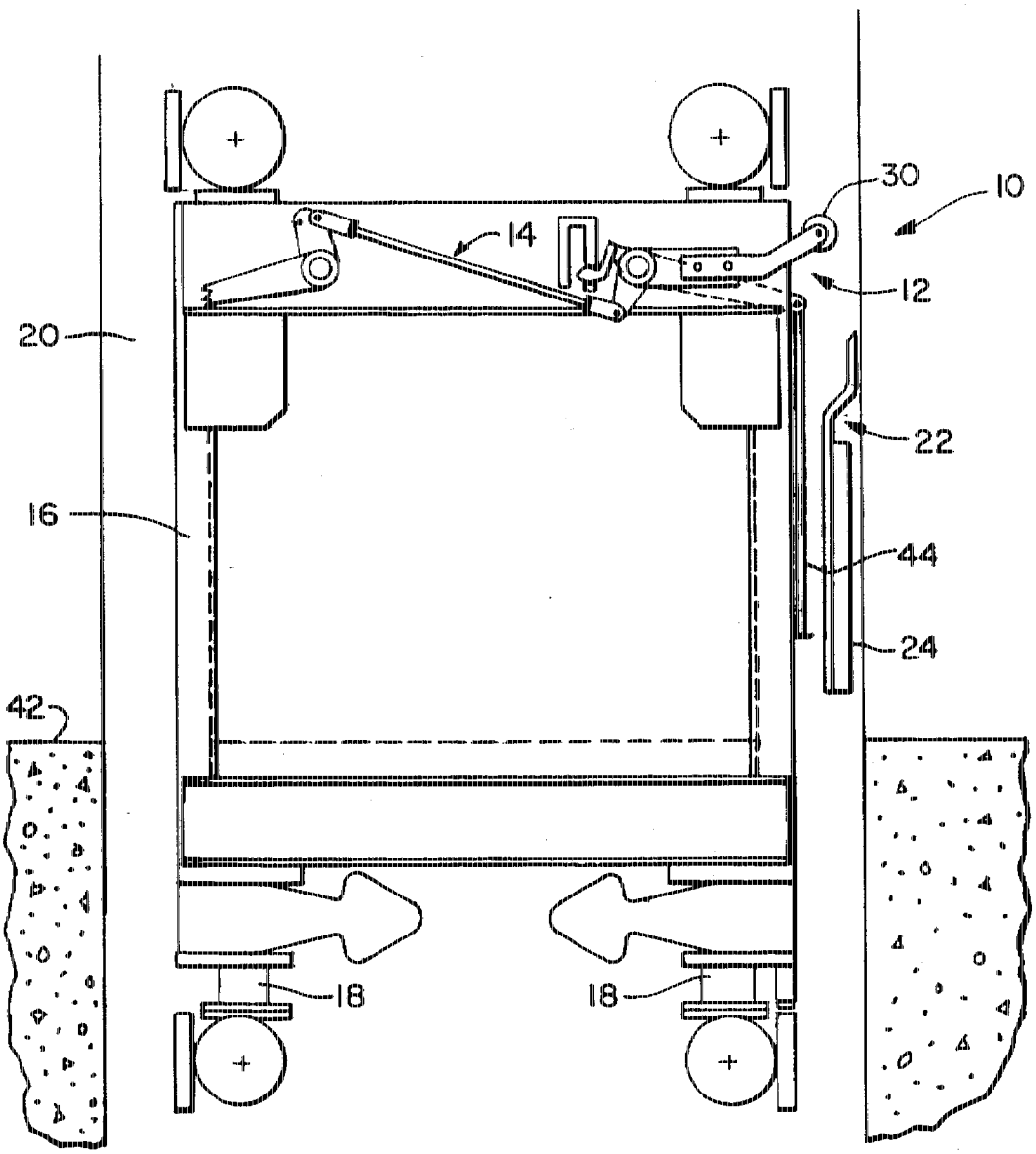
FIG. 1 is a cross-sectional view on an elevator car, including a system for engaging safeties on an elevator car of the present invention.

An embodiment of a system for engaging safeties on an elevator car 10, employing the concepts of the present invention, is illustrated in FIG. 1. A safety tripping lever 12 is fastened to conventional safety linkages 14 on an elevator car 16. The linkages 14 conventionally actuate the car's safeties 18, which when engaged, grip guide rails 20 and consequently slow the speed of the car 16. A cam 22 is mounted to a hoistway wall 24 at a location corresponding to a lowest landing 42 for the car 16. If the car 16 passes the lowest landing 42, the cam 22 trips the lever 12, thereby actuating the safeties 18, and slowing the car 16 until it comes to a stop.

Safety Tripping Lever and Cam

Figure 2A:
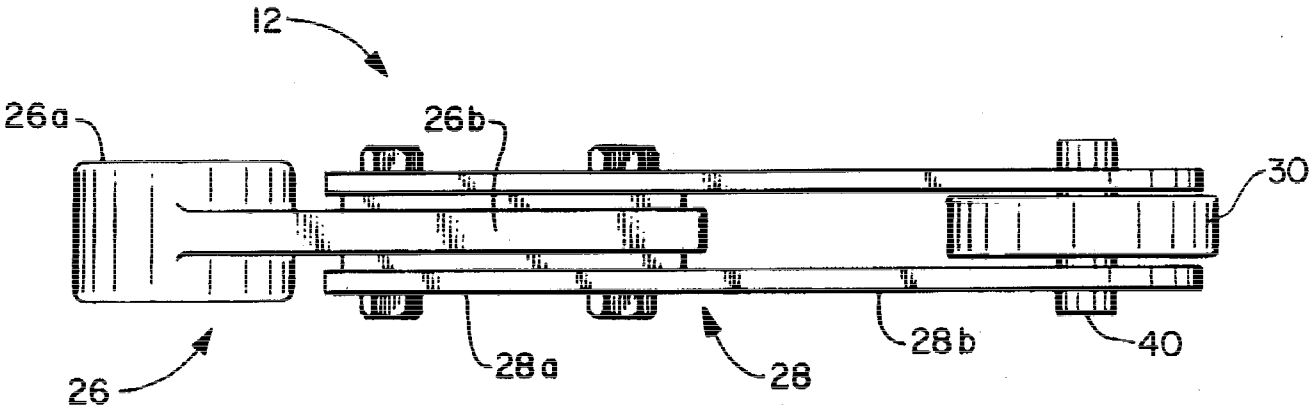
FIG. 2A is a top view of the safety tripping lever of FIG. 2.
Figure 2:
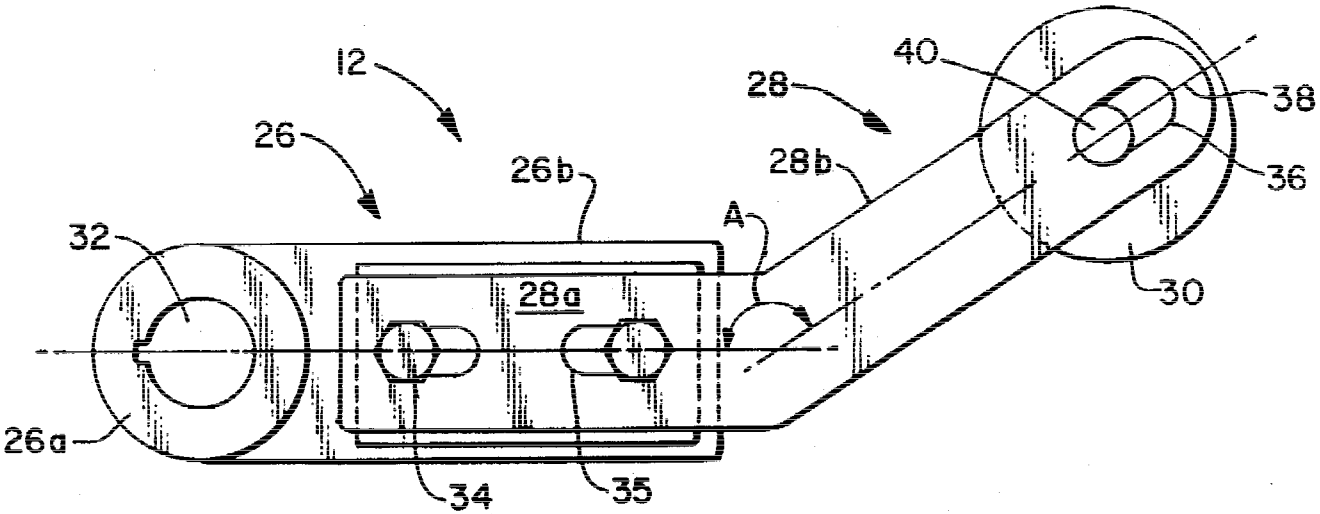
FIG. 2 is a front view of a safety tripping lever.

FIG. 2 depicts a safety tripping lever 12, comprising, a mounting plate 26, an angled arm 28, and a roller 30.

The mounting plate 26 contains a first portion **26*a* for attaching to the linkages 14, and a second portion 26*b* for attaching to the angled arm 28. The first portion 26*a* of the mounting plate 26 contains a bore 32 for use in conventionally mounting the mounting plate 26 to the linkages 14. The second portion 26*b* of the mounting plate 26 contains bolts 34 for adjustably fastening the angled arm 28 to the mounting plate 26**.

The angled arm 28 contains a base portion **28*a* and a distal portion 28*b*, wherein the distal portion 28*b* is connected to the base portion 28*a* at an angle A. This angle A is variable, and depends on factors including, but not limited to, the length of the lever 12, the distance between the base of the lever 12 and the cam 22, the amount of lever 12 movement necessary to actuate the safeties 18, the shape of the cam 22, and the diameter of the roller 30**.

As depicted in FIG. 2A, the base portion **28*a* of the angled arm 28 has a forked shape, wherein the distance between forks are spaced such that the base portion 28*a* can fit over the second portion 26*b* of the mounting plate 26. As depicted in FIG. 2, the base portion 28*a* contains first ovaloid slots 35, wherein the first ovaloid slots 35 are positioned such that they correspond to the location of the bolts 34 in the second portion 26*b* of the mounting plate 26. When the base portion 28*a* of the angled arm 28 is placed over the second portion 26*b* of the mounting plate 26, the bolts 34 are placed through the first ovaloid slots 35 and are threaded into the second portion 26*b* of the mounting plate 26. Enough space is provided between each of the bolts 34, and the sides of each of the first ovaloid slots 35 to provide enough room to horizontally adjust the angled arm 28 vis-à-vis the mounting plate 26**.

As depicted in FIGS. 2 and 2A, the distal portion **28*b* of the angled arm 28 is forked, and contains second ovaloid slots 36. The second ovaloid slots 36 contain major axes 38 that are substantially parallel to upper and lower edges 28*c*,*d* of the angled arm 28**.

The roller 30 contains a fixed shaft 40, wherein the axis of rotation of the shaft 40 is collinear with the axis of rotation of the roller 30. The width of the shaft 40 is greater than the width of the distal portion **28*b* of the angled arm 28, such that the roller 30 may be placed between the forks of the distal portion 28*b* of the angled arm 28, with the shaft 40 extending through the second ovaloid slots 36. Enough clearance should be provided between the shaft 40 and the second ovaloid slots 36 so that the shaft 40 can rotate within the second ovaloid slots 36**.

Figure 3:
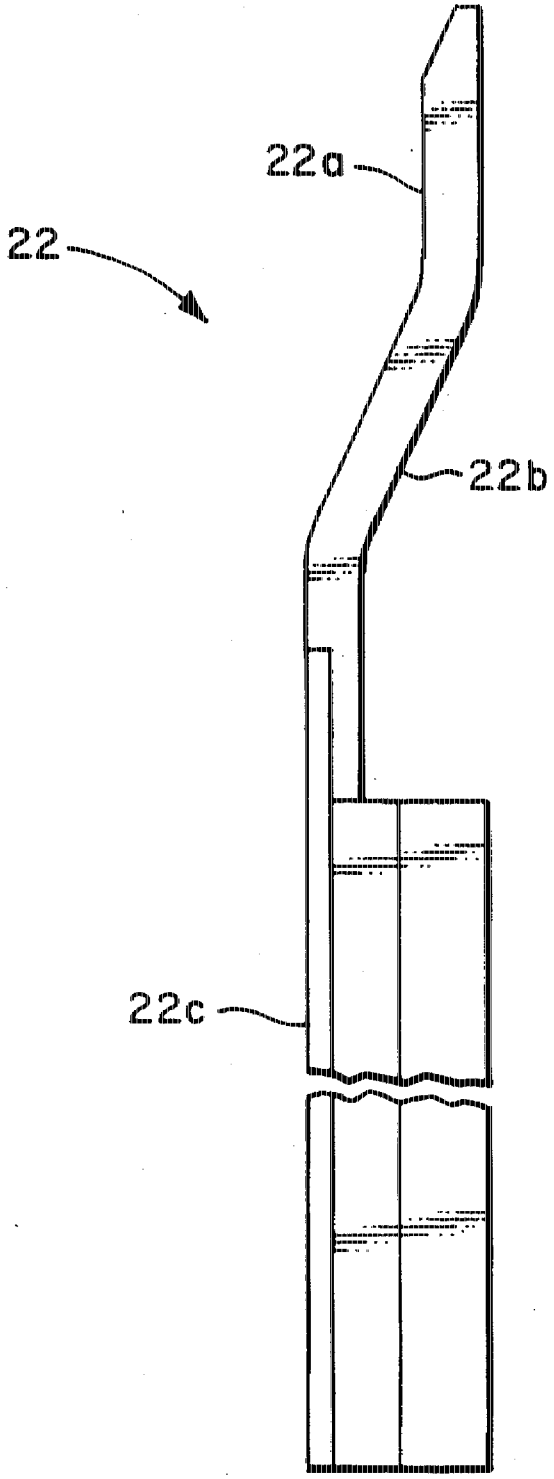
FIG. 3 is a side view, partly broken away, of a cam.

As depicted in FIG. 3, the cam 22 comprises a member bent in two locations, wherein the bends in the cam 22 form an upper portion **22*a*, a transition portion 22*b*, and a lower portion 22*c*. Upon mounting of the cam 22 to the hoistway wall 24, the upper portion 22*a* and lower portions 22*c* are disposed in parallel to the hoistway wall 24, wherein the upper portion 22*a* is located close to the hoistway wall 24, and the lower portion 22*c* is location further away from the hoistway wall 24. The transition portion 22*b* is disposed at an angle to the hoistway wall 24, wherein the transition portion 22*b* bridges the gap between the upper portion 22*a* and the lower portion 22*c*. The lower portion 22*c* extends downward a distance corresponding to a distance necessary for the elevator car 16 to come to a stop after the safeties 18** have been engaged.

System Operation

In operation, the cam 22 is fixed to the hoistway wall 24 at a location where it is desired to engage the elevator's safeties 18. In a preferred embodiment, this location corresponds to a point where the elevator car 16 passes the lowest landing 42 of the hoistway. The safety tripping lever 12 and the cam 22 are positioned relative to one another such that as the lever 12 passes the cam 22, the two make contact.

Figure 4:
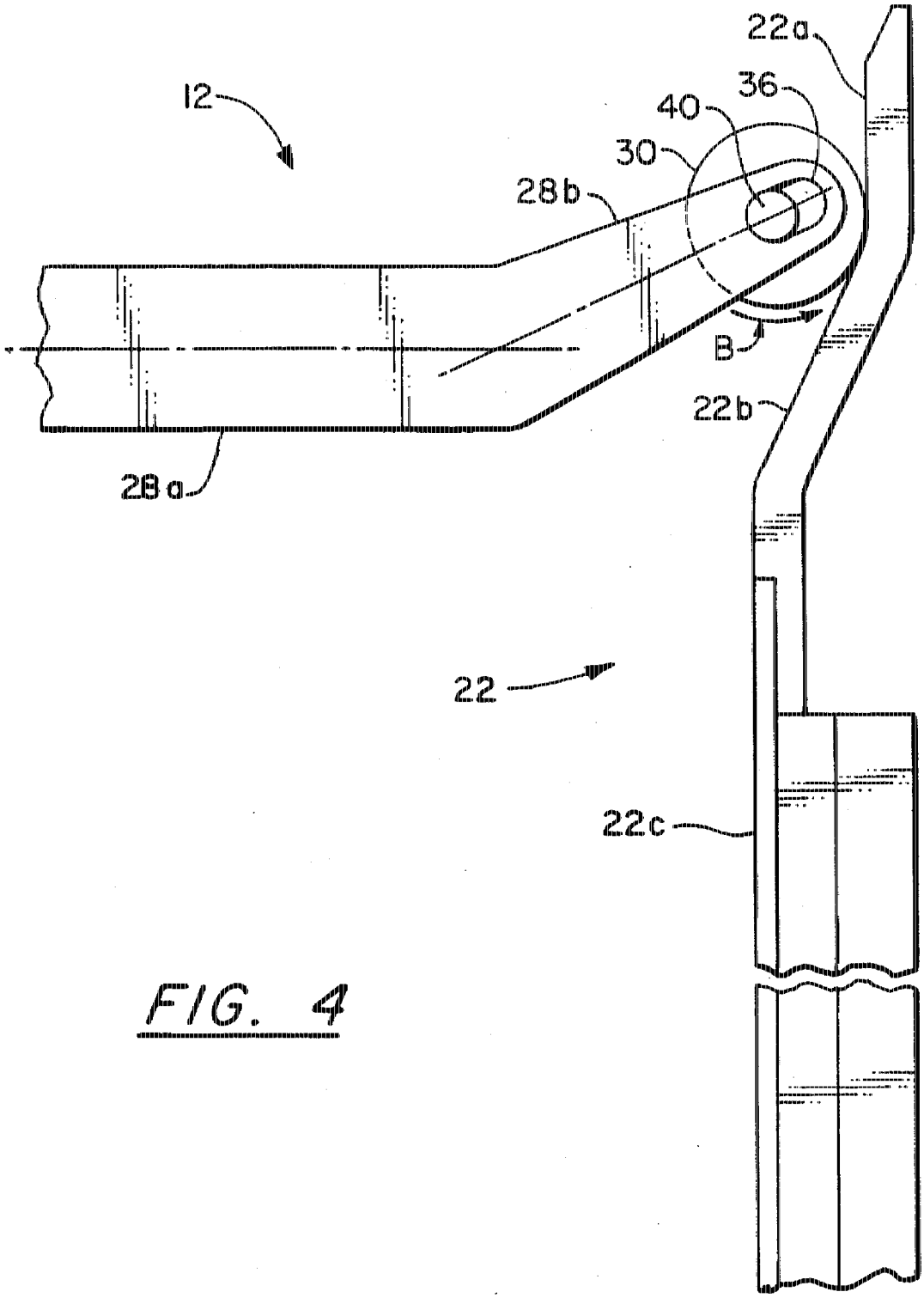
FIG. 4 is a side view of the lever as it makes contact between a upper portion and transition portion of the cam.

As depicted in FIG. 4, as the lever 12 strikes the upper portion 22*a* of the cam 22, the shaft 40 of the roller 30 sits in the second ovaloid slots 36 at a point proximal to the base portion 28*a* of the angled arm 28. As the lever 12 moves down the cam 22 to the transition portion 22*b*, friction between the cam 22 and the roller 30, causes the roller 30 to rotate in a direction B.

Figure 5:
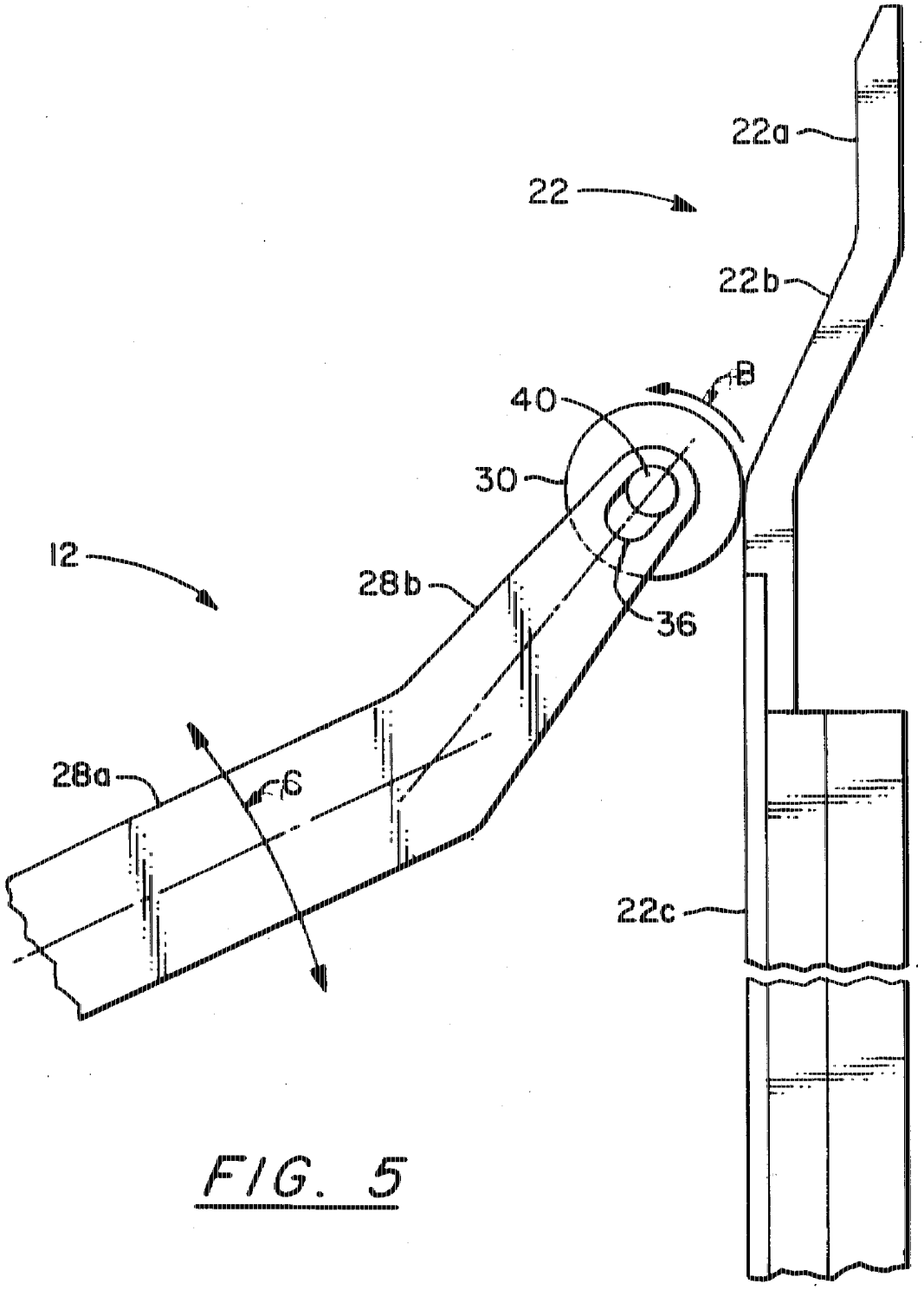
FIG. 5 is a side view of the lever as it makes contact between the transition portion and a lower portion of the cam.

As depicted in FIG. 5, as the lever 12 passes through the transition portion 22*b* of the cam 22, the shape of the transition portion 22*b* causes the lever 12 to pivot upwards in a direction C about the first portion 26*a* of the mounting plate 26. As the lever 12 is pivoting, the motion of the lever 12 causes corresponding movement in the elevator's linkages 14 and lift rods 44 as is known in the art, thereby engaging the elevator's safeties 18.

At the same time that the lever 12 is pivoting, the upward frictional forces on the roller 30 from the cam 30, and the rotation of the roller 30 against the cam 22, causes the shaft 40 of the roller 30 to travel within the second ovaloid slots 36 to a point in the second ovaloid slots 36 distal from the base portion 28*a* of the angled arm 28.

Figure 6:
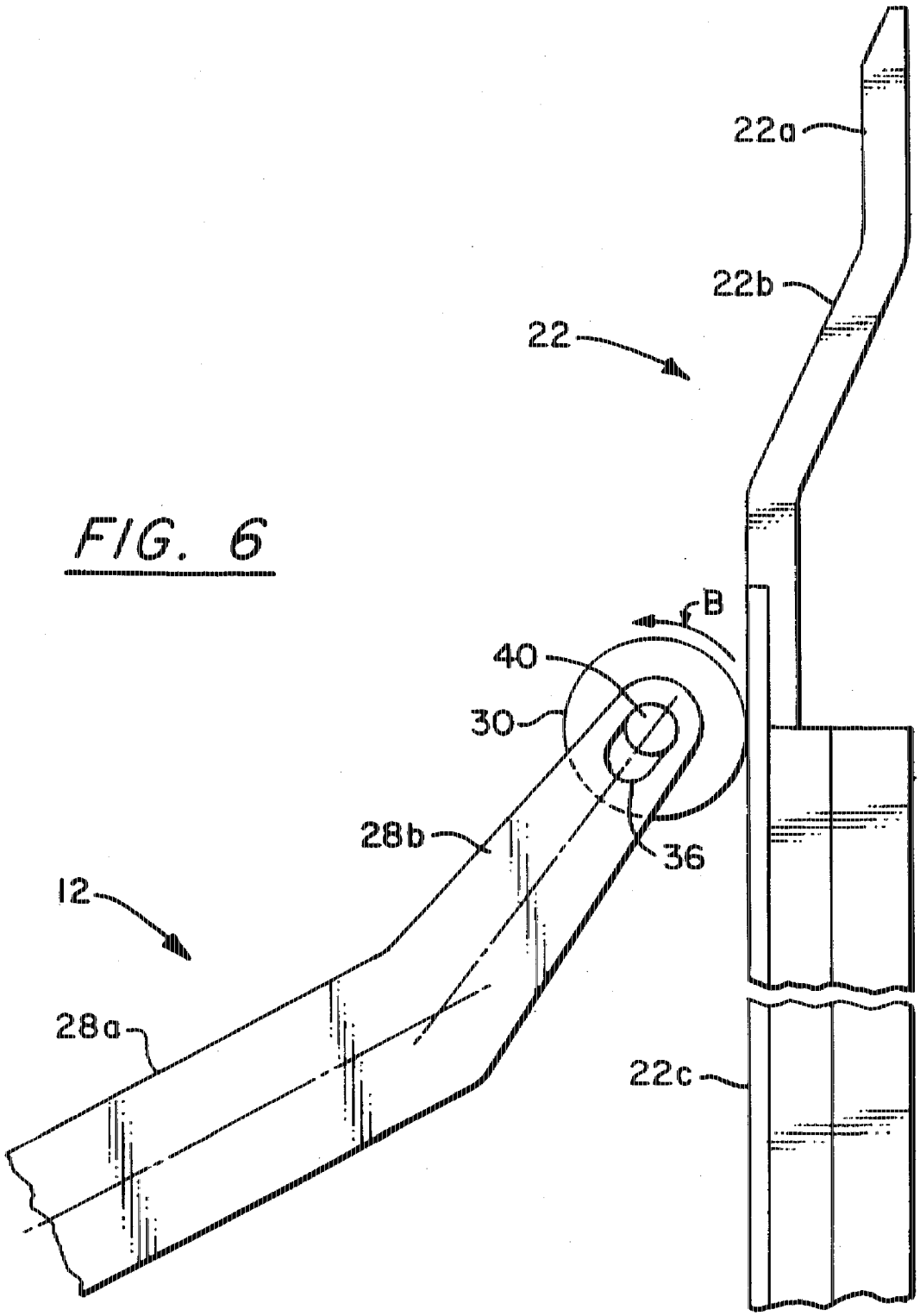
FIG. 6 is a side view of the lever as it maintains contact with the lower portion of the cam.

As depicted in FIG. 6, as the lever 12 traverses the lower portion 22*c* of the cam 22, the lever 12 is pivoted to a maximum point along the pivoting direction C, thereby corresponding to a maximum braking force by the safeties 18. Since the length of the lower portion 22*c* of the cam 22 corresponds to the distance necessary for the safeties 18 to bring the car 16 to a stop, the lower portion of the cam 22*c* maintains pressure against the lever 12 while the safeties 18 are braking, thereby ensuring that the lever 12 does not rotate back down and disengage the safeties 18.

It is known that conventional safeties use wedges as means for applying pressure to the elevator guide rails, thereby causing the desired braking forces. These wedge safeties typically exert braking forces in one direction of car travel, and due to their geometry, release when the car travels in an opposite direction. The prior art safety tripping system with the short length cam, has no means to ensure that the lever is held in an upward position, thereby maintaining the safeties in an engaged position. Therefore, if the guide rails in the hoistway are misaligned due to shifting and settling of a building in which the elevator is mounted for travel, then it may be possible that after the prior art lever is tripped, a misaligned joint in the guide rails could force up the wedges, thereby disengaging the safeties. Since there is nothing in the prior art system to hold the lever upright, the lever will drop as the safeties disengage.

In the present invention, after the lever 12 makes contact with the cam 22 and the safeties 18 engage, any imperfections in the guide rails (not shown) may still exert releasing forces on the wedges (not shown), however, the fact that the lever 12 presses up against the cam 22 throughout the braking distance, physically prevents the safeties 18 from disengaging.

Figure 7:
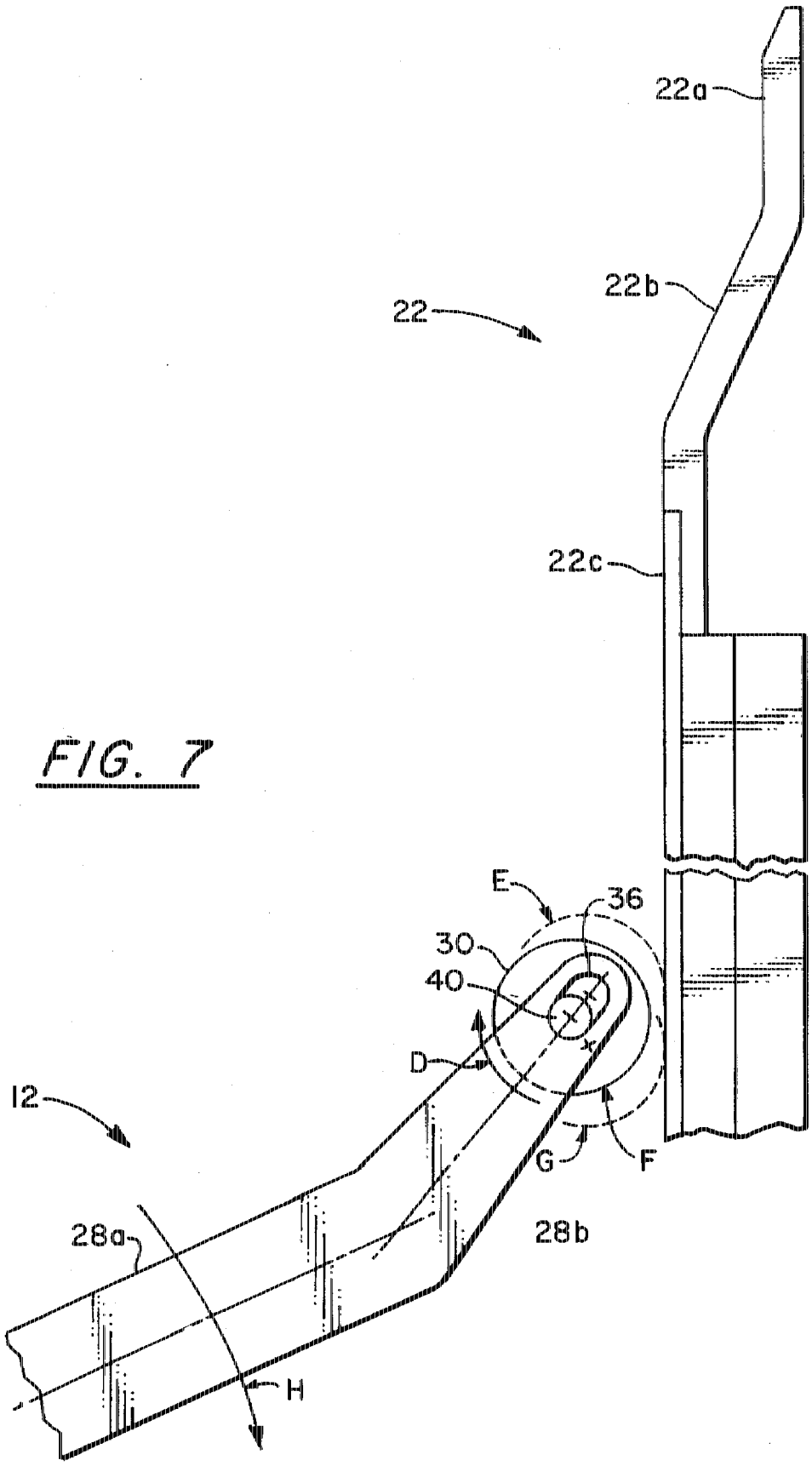
FIG. 7 is a side view of the lever and the cam, showing a three position motion of a roller.

To disengage the safeties 18 after the car 16 has come to a stop, the car 16 is lifted in an upward direction, forcing the wedges in the safeties 18 up, and thereby disengaging the safeties 18. As depicted in FIG. 7, as the safeties 18 are disengaging and the car 16 is moving upward, the roller 30 is in a first position E as the frictional forces between the roller 30 and the cam 22 causes the roller 30 to rotate in a direction D. The rotation of the roller 30 in this direction D and the downward frictional forces between the roller 30 and the cam 22 causes the shaft 40 of the roller 30 to move within the second ovaloid slots 36 to a position proximal to the base 28*a* of the angled arm 28, thereby moving the roller 30 to a second position F.

As the car 16 moves upward, the lever 12 begins to pivot in a downward pivoting direction H, thereby causing the roller 30 to assume a third position G, wherein the roller 30 makes contact with the cam 22 once again. The position of the roller 30, coupled with the angle A of the angled arm 28, and the upward motion of the car 16, ensures that the lever 12 does not interfere with the disengaging of the safeties 18 as the car 16 is lifted upwards.

Alternative Embodiments

It will be readily seen by one of ordinary skill in the art that the present invention fulfills all the objects set forth above. After reading the foregoing specification, one of ordinary skill will be able to effect various changes, substitutions of equivalents and various other aspects of the invention as broadly disclosed herein.

In alternative embodiments of the present invention, the cam 22 may have a shape other than the shape described in the preferred embodiment. The length of the top portion 22*a*, transition portion 22*b*, and the lower portion 22*c* of the cam 22 may be different than as described for a preferred embodiment, with the proviso that the cam 22 must have a lower portion 22*c* long enough to ensure that the lever 12 is held in a position that will engage the safeties 18 for a distance necessary to bring the car 16 to a stop.

In alternative embodiments, the size of the roller 30, the length of the major axes 38 of the second ovaloid slots 36, the angle A of the angled arm 28, and the total length of the lever 12, may all be adjusted to different dimensions and still preserve the features of the present invention. All of these elements may be adjusted to facilitate the proper engaging of the safeties 18, and also allow for the safeties 18 to be disengaged without the cam 22 interfering with the lowering of the lever 12.

In addition, the manner in which the lever 12 actuates the safeties 18 may be different than in the preferred embodiment. In alternative embodiments, the lever 12 does not necessarily have to be connected to linkages 14 and lift rods 44, However, the lever 12 should still be able to actuate the safeties 18 once the lever 18 is tripped. These alternative connection means may include mechanical, electrical, magnetic, or electro-mechanical means.

Various changes to the above description may be made without departing from the spirit and scope of the present invention as would be obvious to one of ordinary skill in the art of the present invention. It is intended that the protection granted hereon be limited only by the definition contained in the appended claims and equivalents thereof.

What is claimed is:

1. A system for engaging safeties on an elevator car, said car requiring a certain distance to stop, said safeties stopping movement of said car in a traveling direction, said system comprising:

(a) a safety tripping lever, said safety tripping lever including a roller having a fixed shaft received within an ovaloid slot disposed in said safety tripping lever, said safety tripping lever having an extended configuration when said shaft is located at one end at one end of said ovaloid slot and a retracted configuration when said shaft is located at an other end of said ovaloid slot, said safety tripping lever having a first position and a second position, said safeties being disengaged when said safety tripping lever is in said first position, said safeties being engaged when said safety tripping lever is in said second position; and (b) contact means for engaging said roller to move said safety tripping lever from said first position to said second position and for moving said safety tripping lever from said retracted configuration to said extended configuration, a first portion of said contact means having a length substantially equal to said certain distance required to stop said car, said safety tripping lever moving from said first position to said second position upon contact of said safety tripping lever with said contact means, said contact means moving said safety tripping lever from said retracted configuration to said extended configuration upon contact of said safety tripping lever with said contact means, said contact means preventing said safety tripping lever from moving from said second position to said first position when said safety tripping arm is in said extended configuration, said contact means allowing said safety tripping lever to move from said second position to said first position when said safety tripping lever is in said retracted configuration, said contact means moving said safety tripping lever from said extended configuration to said retracted configuration upon movement of said elevator car in a direction opposite of said traveling direction.

2. A system for engaging safeties on an elevator car as claimed in claim 1, wherein:

said contact means is a cam.

* * * * *